United States Patent [19]

Andrews et al.

[11] Patent Number: 4,882,562

[45] Date of Patent: Nov. 21, 1989

[54] ADAPTOR FOR COUPLING PLURAL COMPRESSION DRIVERS TO A COMMON HORN

[75] Inventors: Anthony J. Andrews, Capel; Toby C. Hunt, Rusper, both of England

[73] Assignee: Turbosound Limited, England

[21] Appl. No.: 147,647

[22] Filed: Jan. 25, 1988

Related U.S. Application Data

[63] Continuation of Ser. No. 838,364, Mar. 11, 1986, abandoned.

[51] Int. Cl.[4] ..... G08B 3/00

[52] U.S. Cl. ..... 340/388; 181/185; 340/384 R; 381/156

[58] Field of Search ..... 340/384 R, 388, 393, 340/404, 402; 181/144, 152, 153, 159, 163, 182, 185, 187, 186, 189, 191, 192, 177; 367/6, 153, 156; 381/156

[56] References Cited

U.S. PATENT DOCUMENTS

| | | | |
|---|---|---|---|
| Re. 32,183 | 6/1986 | Isaacs | 181/159 |
| 769,448 | 9/1904 | O'Connor . | |
| 1,637,322 | 7/1927 | Weil . | |
| 1,690,840 | 11/1928 | Round . | |
| 1,707,545 | 4/1929 | Wente . | |
| 1,711,939 | 5/1929 | Graff . | |
| 1,767,679 | 6/1930 | Hutchison . | |
| 1,776,902 | 9/1930 | Harrison | 181/187 |
| 1,845,768 | 2/1932 | Stokes . | |
| 1,907,723 | 5/1933 | Bostwick . | |
| 1,935,788 | 11/1933 | Critchfield | 340/388 |
| 2,058,208 | 10/1936 | Blattner | 181/27 |
| 2,102,668 | 12/1937 | Ballantine | 181/159 |
| 2,295,527 | 9/1942 | Bowley | 179/116 |
| 2,550,359 | 4/1951 | Levy | 181/27 |
| 2,638,510 | 5/1953 | Brami | 179/115.5 |
| 2,832,845 | 4/1958 | Levy | 179/115.5 |

(List continued on next page.)

FOREIGN PATENT DOCUMENTS

| | | |
|---|---|---|
| 290387 | 5/1928 | United Kingdom . |
| 637646 | 5/1950 | United Kingdom . |
| 355897 | 9/1981 | United Kingdom . |

OTHER PUBLICATIONS

TASCO Drawing No. 07/01, d. 11/20/80.

J. R. Bost, "A New Type of Tweeter Horn Employs a Piezoelectric Driver", Electro-Voice, Specifications and Instructions Models T35B, T35 & T350 spec. sheet.

Electro-Voice Engineering Data T-35 VHF Compression Driver spec. sheet.

Wente & Thuras, "A High-Efficiency Receiver for a Horn-Type Loudspeaker of Large Power Capacity", AES Journal, Mar. 1978.

VORTEC HF 3000 Ring Radiator Tweeter spec. sheet.

D.A.S. Mod. K-k spec. sheet.

Acoustical Engineering, by H. F. Olson, 1957, pp. 212-245.

Yamaha White Paper—"A Comparison of Several Manufacturers' Speaker Components for Sound Reinforcement Loudspeaker Systems", Oct. 1981.

*Primary Examiner*—Joseph A. Orsino

*Assistant Examiner*—Brent Swarthout

*Attorney, Agent, or Firm*—Kenyon & Kenyon

[57] ABSTRACT

An improved adaptor for coupling a plurality of compression drivers to the throat of a common horn is disclosed. The improved adaptor of the present invention includes a passage coupled to each of the plurality of compression drivers, the passages extending forwardly toward the horn. A longitudinally extending central member is mounted within the horn flare, extending along its central axis and tapering forwardly. The surfaces of the horn flare and the central member define an annular region between the side walls of the horn flare and the central member. The passages for each of the compression drivers are connected with this annular region. The adaptor therefore comprises a manifold whose passages operate into three symmetrical sectors of the annular passage formed by the insertion of the central member into the horn flare.

22 Claims, 6 Drawing Sheets

U.S. PATENT DOCUMENTS

| | | | |
|---|---|---|---|
| 2,858,377 | 10/1958 | Levy | 179/115.5 |
| 2,907,837 | 10/1959 | Brami | 179/115.5 |
| 3,672,462 | 6/1972 | Auer, Jr. | 181/0.5 R |
| 3,866,710 | 2/1975 | Cesati | 181/152 |
| 3,972,385 | 8/1976 | Hino et al. | 181/192 |
| 4,031,337 | 6/1977 | Okamura et al. | 179/115.5 |
| 4,040,503 | 5/1976 | Hino et al. | 181/192 |
| 4,050,541 | 9/1977 | Henricksen | 181/159 |
| 4,143,738 | 3/1979 | Nakazono et al. | 181/159 |
| 4,152,552 | 5/1979 | Meyer | 179/115.5 |
| 4,181,193 | 1/1980 | Isaac | 181/185 |
| 4,194,590 | 3/1980 | Anderson et al. | 181/186 |
| 4,310,065 | 1/1982 | Kayman | 181/159 |
| 4,325,456 | 4/1982 | Ureda | 181/159 |
| 4,344,504 | 8/1982 | Howze | 181/187 |
| 4,629,029 | 12/1986 | Gunness | 181/144 |

ADAPTOR FOR COUPLING PLURAL COMPRESSION DRIVERS TO A COMMON HORN

This application is a continuation, of application Ser. No. 838,364, filed 3/11/86, now abandoned.

This application relates to sound reinforcement equipment and, more specifically, to an improved apparatus for coupling multiple high-frequency compression drivers to a common horn flare.

BACKGROUND OF THE INVENTION

Many sound reinforcement applications require the accurate reproduction of live or recorded program material that has a wide frequency range, typically 40–18,000 Hz. Yet no single transducer practical for use in the art is capable of both accurately and efficiently reproducing this range of frequencies at high power levels. As a result, virtually all sound reinforcement systems electronically divide the program material into two to five separate frequency bands and provide a separate transducer subsystem for each band, optimized for the reproduction of its range of frequencies.

This use of plural subsystems for the reproduction of full range program material has many associated disadvantages including not just its impact on the total size, weight, cost and complexity of the system, but losses in the fidelity of reproduction produced by discrepancies between the various transducer subsystems in dispersion, transient response, projection, phase/time alignment, and tonal quality. The aural disadvantages of multiple transducer use are particularly important at higher frequencies where shorter wavelengths increase both the incidence and severity of phase cancellation effects between transducers operating in adjacent frequency bands as well as between transducers operating in the same frequency band where their dispersions overlap.

It has therefore, long been an object to reproduce full range program material using the minimum practical number of transducer subsystems, and, particularly in the high frequency region, with the minimum practical number of transducers. As a result, efforts have long been devoted to methods of increasing both the useable frequency range of high frequency components and their power handling ability.

Basic physical factors have, however, seemed to render impractical the combination of extended high frequency response and the high power handling ability required to achieve the object of minimizing both the number of transducers and of transducer types required for the high frequency portion of a sound reinforcement system. The decreasing wavelengths of higher frequencies place a premium on transducers whose active surface area (diaphragm) is small, and as such, capable of rapid acceleration and deceleration by the electromechanical motor of the transducer. Accordingly, a "1-inch" compression driver, such as the Electro-Voice DH2305 is capable of the desired extended high frequency response. Conversely, the limited size of the elements of the transducer also place limits on its power-handling capability, limits which render the "1-inch" driver inadequate for most high-level sound reinforcement applications.

Obviously, the size of the transducer can be scaled up to increase its power handling capability. "2-inch" compression drivers are readily available, and their increased size does indeed increase power handling ability, but not without tradeoffs. Increasing the size and mass of the active area of the transducer/diaphragm also serves to reduce the efficiency with it can reproduce higher frequencies. As a result (as illustrated in FIG. 1), the improvement in power handling is largely offset by a marked reduction in high-frequency response. If the "2-inch" driver is employed as the sole high-frequency transducer, then extended range high-frequency reproduction can only be maintained by electronically decreasing the efficiency of the driver at lower frequencies through frequency-selective attenuation of the program material such that the transducer subsystem as a whole displays a more consistent frequency response. This, however, sets a limit on the power-handling ability of the driver which offsets much of the benefit of the increase in size. Further, the increased size and mass of the diaphragm reduces the transient response of the driver, which is particularly noticeable at higher frequencies. These effects many be reduced by the use of exotic diaphragm materials but only at a very substantial increase in per unit cost and decrease in reliability which has priced drivers employing such materials out of reach of most users.

Alternatively, the high frequency region may be further divided, the lower portion of the band (typically that below 6–7 kHz) reproduced by the "2-inch" compression driver, and the upper portion by a specialized high frequency driver, the "super tweeter". This allows the compression driver to operate in the most efficient portion of its range and hence increases its power handling ability, but results in the various practical and aural disadvantages of multiple transducer subsystem use previously described.

If, therefore, 1-inch compression drivers are inherently the optimal driver for extended range high-frequency reproduction, then some method of bringing a plurality of them to bear on a common axis is required for accurate reproduction of full range program material in high-power sound reinforcement applications.

In such applications, it would be obvious to simply employ a plurality of such compression drivers and their associated horns aimed along a common axis, but phase-cancellation effects between the pressure waves of the plurality of radiators are severe enough to render this approach less than satisfactory.

Alternatively, an apparatus may be used to couple a plurality of such drivers to the throat of a common horn. This has the benefit of producing a single source and would therefore be expected to prevent the phase-cancellation effects of plural radiators, but prior art apparatus of this type has only succeeded in localizing the phase-cancellation effects within the multiple-driver adaptor itself. The benefits of such adaptors have thus been offset by an increase in distortion product such that, despite their potential advantages, few full-range professional sound reinforcement systems employ them.

The potential advantages of such a multiple-driver approach to high-frequency sound reproduction are, nonetheless, so substantial that designers of sound reinforcement equipment have, over the last half century, devoted considerable attention to the development of a multiple-driver adaptor which minimizes distortion product.

Such adaptors comprise a plurality of tubular passages, each coupled on one end to the driver and on the other to an open chamber equal in diameter to the throat of the horn flare to which the adaptor is coupled. In certain embodiments, illustrated by adaptor 30 of FIG. 2, the route of these passages 8 and 8A has been curved. It has been found, however, that lower distortion results if the passages are straight.

Refer now to FIG. 3, a crosssection of a multiple-driver adaptor 33 which represents the best teaching of prior art with respect to proper design of such adaptors. Drivers 1 and 1A are standard 1-inch compression drivers coupled to passages 8 and 8A which are straight. The angle of the passages 8 and 8A have been adjusted with respect to the central axis of the horn flare 2 such that a projection 8P of the wall of the passage will not intersect the wall of the horn flare 2. These features have a significant effect on distortion product, but when applied by the applicants had failed to produce sonic quality improved over that of a single 2-inch driver.

It therefore remains an object to produce a method of coupling multiple compression drivers to the throat of a common horn flare without producing levels of distortion product which offset the potential benefits of such an arrangement.

SUMMARY OF THE INVENTION

The improved adaptor of the present invention includes a passage coupled to each of the plurality of compression drivers, the passages extending forwardly toward the horn. A longitudinally extending central member is mounted within the horn flare, extending along its central axis ad tapering forwardly. The surfaces of the horn flare and the central member define an annular region between the side walls of the horn flare and the central member. The passages for each of the compression drivers are connected with this annular region. The adaptor therefore comprises a manifold whose passages operate into three symmetrical sectors of the annular passage formed by the insertion of the central member into the horn flare.

In contrast to prior art adaptor designs, the improved adaptor of the present invention combines the sound waves produced by the various drivers gradually, as they propagate along a common axis forward through the progressively increasing crosssectional area within the horn. Further, the mixing of sound waves takes place in a region of the system without sharp edges or abrupt changes in crosssectional area. The use of the improved adaptor of the present invention results in a heretofore unprecedented reduction in distortion product relative to prior art adaptor designs.

Similarly, methods are disclosed by which such abrupt changes in crosssectional area may preferrably be minimized at the transition between the passages and the annular region.

The compression effect produced by the substantial reduction in crosssectional area at the transition between the passage and the annular region is also described.

DETAILED DESCRIPTION

Figure 1:
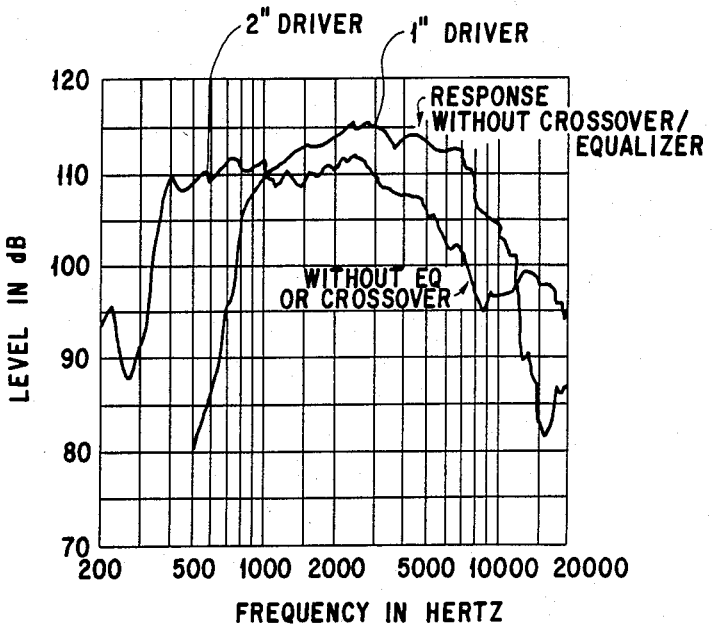
FIG. 1 is a graph illustrating the comparative frequency response of a typical 1-inch and 2-inch compression driver by the same manufacturer.
Figure 2:
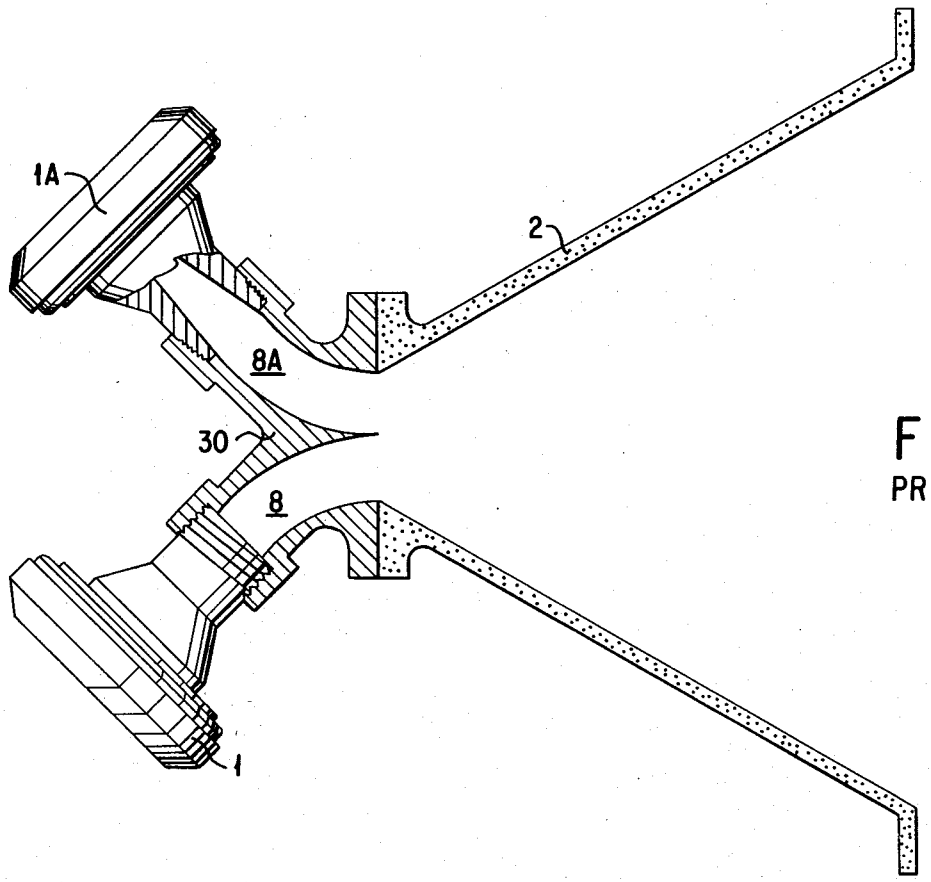
FIG. 2 PRIOR ART
FIG. 2 is a section through a typical prior art multiple driver adaptor having curved passages.
Figure 3:
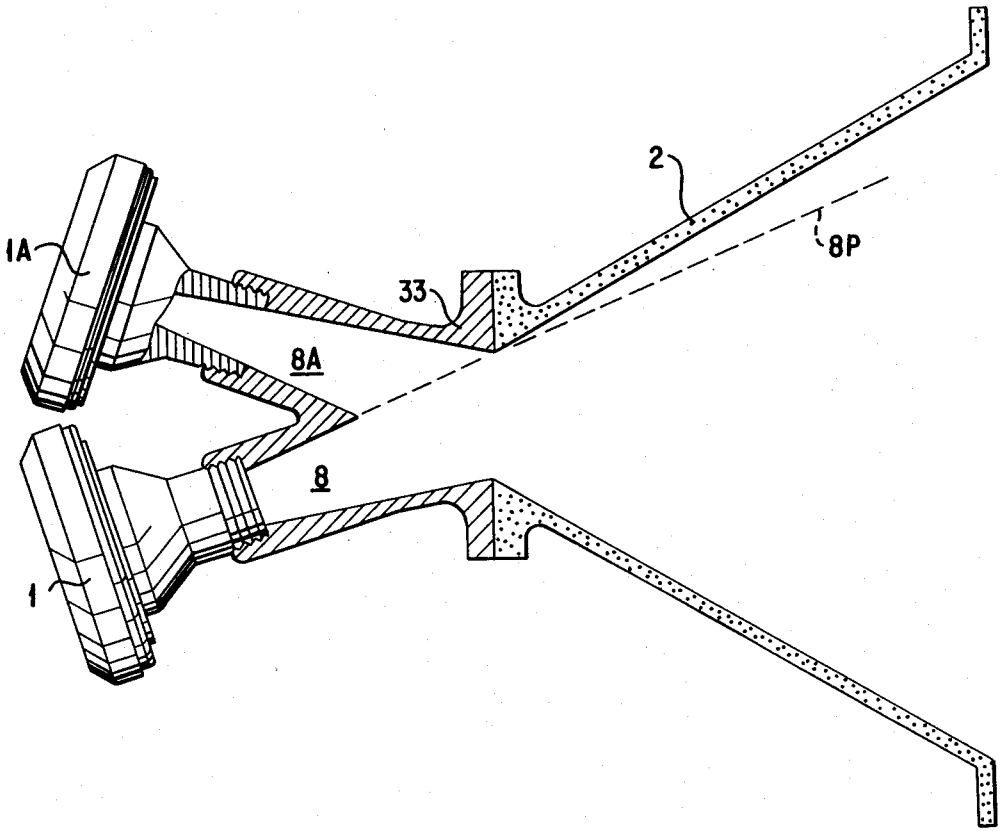
FIG. 3 PRIOR ART
FIG. 3 is a section through a prior art multiple driver adaptor optimized for minimal distortion product.
Figure 4:
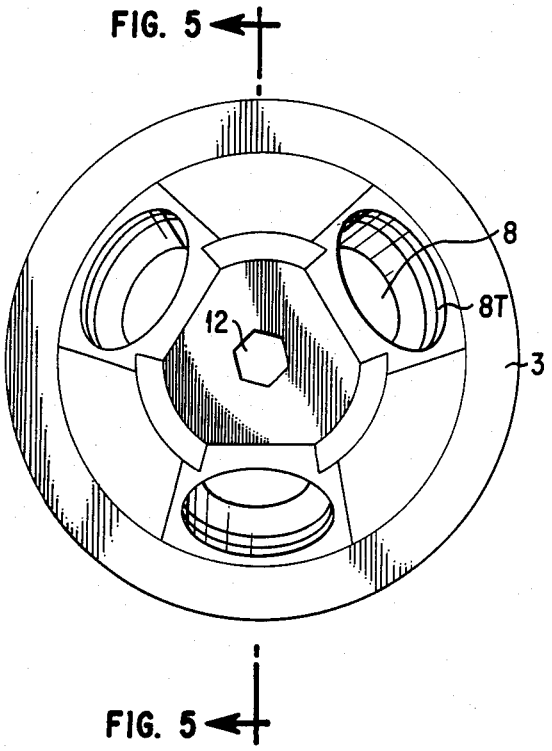
FIG. 4 is a rear elevation of the multiple driver adaptor of the present invention with drivers removed.
Figure 5:
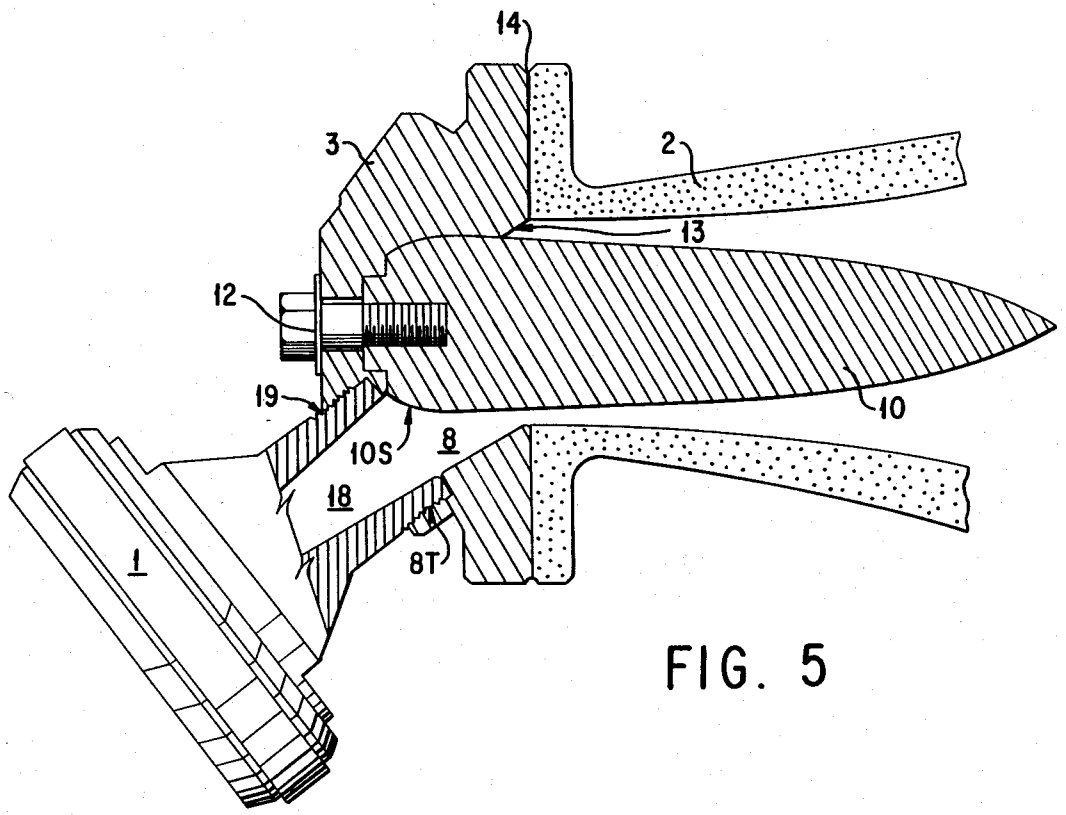
FIG. 5 is a longitudinal section through the multiple driver adaptor of the present invention with both drivers and horn flare installed.
Figure 6:
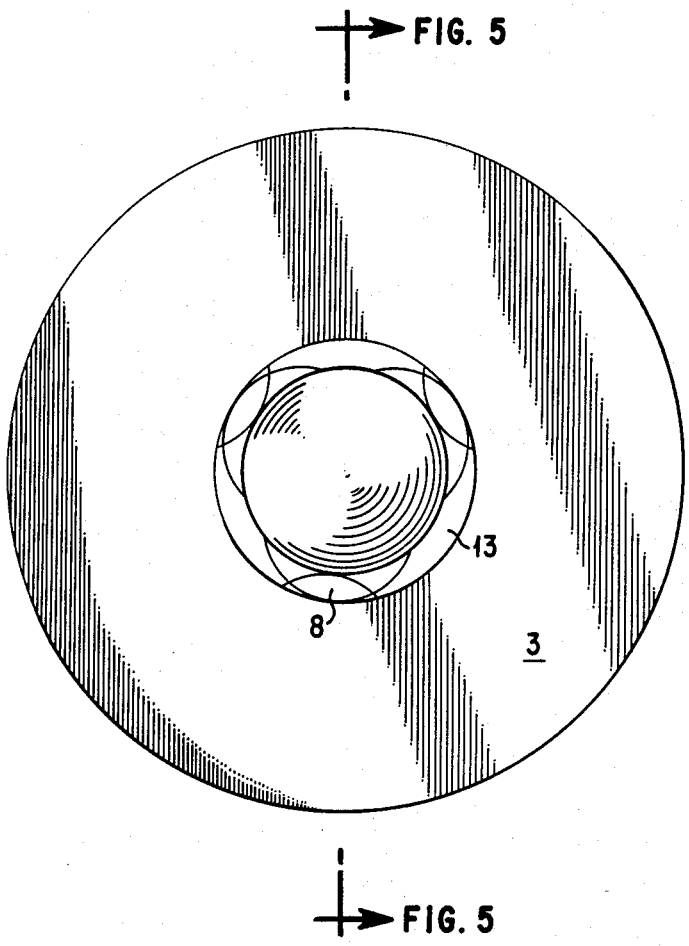
FIG. 6 is a front elevation of the multiple driver adaptor of the present invention.

Refer now to FIGS. 4, 5 and 6, views of one embodiment of the multiple driver adaptor of the present invention.

The adaptor illustrated has been designed to couple three 1-inch compression drivers 1 to the throat of a common horn flare 2 of the throat size normally employed with a single 2-inch compression driver.

The illustrated adaptor comprises a machined aluminum coupler 3, in which one passage 8 for each of the three compression drivers has been bored.

Each such compression driver 1 conducts the acoustic energy produced by the movement of its diaphragm via an internal passage 18 in its housing terminating in an externally-threaded section 19 which is provided to attach the driver to a horn flare. As a method of coupling the drivers 1 to the adaptor, the outer portions 8T of the passages 8 in the coupler 3 have been tapped to receive the externally-threaded portion 19 of the driver 1. This has the benefit of producing both the required mechanical and acoustic coupling of the drivers to the adaptor with a single part which is comparatively simple to fabricate.

It will be understood that other types of compression drivers employ other mounting methods, and that in such cases the design of the coupler will be modified to suit.

Radiation of significant acoustic energy from the driver 1 except via passage 18 is undesirable, and unless driver 1 is of a type which minimizes such radiation, the drivers and adaptor are preferably mounted in a sealed enclosure.

The electrical inputs of drivers 1 may be wired in parallel, series, or series-parallel. Series wiring has the benefit of clearly signalling the failure of any one of the three drivers. In a parallel arrangement the user may not recognize a loss of volume as caused by the failure of one driver and in increasing power to the system to compensate may damage the remaining drivers. Further, series wiring increases the impedance presented to the amplifier, reducing the likelyhood of damage due to power amplifier excursions.

Passages 8 are so oriented that they extend forwardly toward the horn flare 2, and so that their centerlines intersect near the plane 14 at which the coupler is attached to the horn flare.

An elongated central member 10 extends from the coupler 3 to a point substantially forward of the throat of horn flare 2 (in the illustrated embodiment 2 inches).

Preferably the projected side walls of passages 8 intersect the surface of central member 10.

The central member 10 preferably tapers forwardly, and is here illustrated as an aluminum turning secured to the coupler 3 by means of a threaded stud 12. It may be made of metal, plastic, or other suitable material and where manufacturing methods permit, may be formed integral with the coupler.

As illustrated here, the central member 10 is symmetrical about the axis of the horn flare 2, tapering at an increasing rate to a point.

The addition of central member 10 serves to convert the throat of horn flare 2 from a conventional circular crosssection to an annular design. The coupler 3 therefore becomes a manifold whose passages 8 operate into three symmetrical sectors of the annular passage formed by the insertion of the central member 10 into the horn flare 2/coupler 3.

In prior art designs, sound waves exiting passages 8 would meet in the free space defined at the juncture of the adaptor and horn throat. In the adaptor of the present invention, central member 10 prevents the mixing of sound waves in this region, and forces them to propagate forwardly through the annular region defined between the surface of central member 10 and that of horn flare 2/coupler 3. As a result, the sound waves produced by the drivers are united as they move in a common direction. Further, this mixing takes place in a region lacking sharp edges and abrupt changes in crosssectional area.

To this end, those portions 13 of the face of coupler 3 remaining exposed between the intersections of passages 8 with the annular region created by the insertion of central member 10 in horn flare 2 are also preferrably chamferred.

Similarly, the shoulder 10S of central member 10 may be radiused as illustrated - rather than simply bevelled.

Both of these techniques have been found to further reduce distortion product.

The preferred embodiment of the adaptor of the present invention also provides a compression effect through the substantial reduction in crosssectional area created at the intersection of passage and the annular region defined by central member 10 and horn flare 2/coupler 3.

Despite the simplicity of its design and the economy of its construction, the improved adaptor of the present invention is capable of coupling a plurality of standard compression drivers to the throat of a standard horn without the aural disadvantages of prior art adaptors. As a result, three 1-inch compression drivers may be employed with the adaptor of the present invention to produce a power level comparable to that of a 2-inch compression driver at similar cost and with superior transient response. Very significantly, a horn fitted with such an adaptor would be useable over a frequency range extending from 2kHz to 20kHz, eliminating the requirement for a "supertweeter" subsystem which had heretofore been required for full-range, highpowered sound reproduction and the practical and aural disadvantages associated with its use.

While such an adaptor may be fabricated integral with a horn flare, it will be recognized that the design of the adaptor of the present invention allows it to be fitted to virtually any horn flare in current production or use. As a consequence, the adaptor of the present invention may be retrofitted to existing systems in lieu of their 2-inch compression drivers to achieve the advantages previously described.

The benefits of the improved adaptor of the present invention are a product of its basic operating principles, and the variations in its construction should not be understood as limited except by the claims.

While an adaptor for coupling three 1-inch drivers to the throat of a horn normally employed with a single 2-inch driver is illustrated, it will be understood that the same techniques may be employed to couple a greater or lesser number of drivers to a common throat. Similarly, while the illustrated embodiment employs drivers with a horn having different throat sizes, it will be understood that the same techniques may be employed to couple drivers and a horn with the same throat size, for example, two or more 2-inch drivers to the throat of a horn designed for 2-inch drivers.

It will be understood that the design of horn flare 2 may be varied to suit the requirements of the application, and that various types and rates of flare may be employed. Similarly, it will be understood in the context of UK Patent GB-A-1 592 246 and corresponding U.S. Pat. No. 4,181,193 that the sides of horn flare 2 may be parallel and the change in crosssectional area be produced solely by varying the diameter of central member 10 along its length.

It will further be understood in the context of these references, that the insertion of the central member 10 into a horn flare 2 of any shape (parallel-sided, exponential, or other) produces a change in the equivalent crosssectional area of the horn flare at each point along the length of the central member. In embodiments in which the central member does not extend the full length of the horn flare, the central member will modify the crosssectional area of only that portion of the horn flare in which it extends. In either case, the profile of the central member 10 must be selected so that the changes in crosssectional area produced by its insertion in a given horn flare maintain an optimum profile for the desired application. It will therefore be understood that for adaptors designed for use with conventional horn flares it may be desirable to develop a variety of profiles for central member 10, each optimized for use with a specific type of horn flare. The construction of the preferred embodiment of the adaptor of the present invention, which employs a central member 10 attached by a bolt 12 to a coupler 3, simplifies the production, stocking, and assembly of adaptors with a variety of central member profiles. Alternatively, central member 10 may be divided at the plane of the throat 14, the forward portion being interchangeable, and the rearward portion fixed to or integral with the coupler 3. Where horn flares are developed specifically for use with the adaptor, the portion of the central member 10 forward of the plane of the throat 14 may be cast integral with the horn flare.

Various other arrangements of the elements disclosed will be obvious to those skilled in the art.

What is claimed is:

1. An apparatus comprising an adaptor for coupling the acoustic output of a plurality of sound transducers to a common horn, each of said transducers comprising an electromagnetic motor driving a diaphragm, said diaphragm having a surface area and operating into an acoustically isolated chamber having an outlet, said outlet having a cross-sectional area, said cross-sectional area being less than the surface area of said diaphragm, said horn comprising a longitudinally extending channel having acoustically closed sides and an acoustically open outlet at the front, said adaptor including a central, longitudinally extending member mounted within said channel in alignment with the central axis of said channel and tapering towards the outlet of said channel, the surfaces of said longitudinally extending central member and of said channel defining an annular region towards the rear of said channel acoustically common to the output of each of said plurality of transducers, said adaptor including an acoustically isolated passage for each of said transducers, each of said passages coupling said outlet of a respective one of said transducers with said annular region, each of said passages being acoustically separate from a point adjacent said transducers to a point where said passages reach said annular region said annular region including a region wherein the cross-sectional area of said annular region is substantially reduced relative to the sum of the crosssectional areas of said transducer outlets.

2. The apparatus recited in claim 1 wherein said transducers are symmetrically disposed about said central axis.

3. The apparatus recited in claim 1 wherein said central member is rounded at its mounting point at least in the region where said passages meet said annular region.

4. The apparatus recited in claim 1 wherein central member tapers substantially to a point towards the front of said channel.

5. The apparatus recited in claim 1 wherein said transducers comprise compression drivers.

6. An adaptor for coupling the acoustic output of a plurality of sound transducers to a common horn, each of said transducers comprising an electromagnetic motor driving a diaphragm, said diaphragm having a surface area and operating into an acoustically isolated chamber having an outlet, said outlet having a cross-sectional area, said cross-sectional area being less than the surface area of said diaphragm, said horn comprising a longitudinally extending channel having acoustically closed sides and an acoustically open outlet at the front, said adaptor including a central longitudinally extending member adapted so as, in use, to be mounted within said channel in alignment with the central axis of said channel whereby, with the adaptor so mounted, the surfaces of said longitudinally extending central member and of said channel define an annular region towards the rear of said channel acoustically common to said output of each of said plurality of transducers, said adaptor including means for mounting each of said transducers thereon, and including an acoustically isolated passage for each of said transducers, for coupling respective ones of said transducer outlets with said annular region, each of said passages being acoustically separate from a point adjacent said transducers to a point where said passages reach said annular region said annular region including a region of. substantially reduced cross-sectional area relative to the sum of said cross-sectional areas of said transducer outlets.

7. The adaptor recited in claim 6 wherein said mounting means are adapted to mount said transducers symmetrically about said central axis.

8. The adaptor recited in claim 6 wherein said central member is rounded at its mounting point at least in the region where said passages meet said annular region.

9. The adaptor recited in claim 6 wherein said central member tapers substantially to point towards the front of said channel.

10. An adaptor for combining the acoustic outputs of a plurality of sound transducers, said adaptor including an adaptor body having means for mounting the transducers thereon and a member projecting forwardly of the adaptor body, the member tapering in the direction away from the adaptor body, the adaptor body including a plurality of acoustically isolated passages each for directing the output of a respective one of said transducers from an inlet to an acoustically common annular region of space surrounding the forwardly projecting member, each of said passages being acoustically separate from a point adjacent said transducers to a point where said passages reach said annular region said inlet having a cross-sectional area, said cross-sectional area of said acoustically common annular region of space including a region of substantially reduced cross-sectional area relative to the sum of said cross-sectional areas of said inlets.

11. The adaptor recited in claim 10 wherein said mounting means are adapted to mount said transducers symmetrically about the longitudinal axis of the forwardly projecting member.

12. The adaptor recited in claim 10 wherein said forwardly projecting member is rounded at its mounting point at least in the region where said passages meet said annular region.

13. The adaptor recited in claim 10 wherein said forwardly projecting member tapers substantially to point towards the front of said channel.

14. Sound reproduction apparatus comprising a plurality of sound transducers and an adaptor for combining the acoustic outputs of said transducers, said adaptor including an adaptor body having said transducers mounted thereon and a member projected forwardly of the adaptor body, the member tapering in the direction away from the adaptor body, the adaptor body including a plurality of acoustically isolated passages each for directing the output of a respective one of said transducers from an inlet to an acoustically common annular region of space surrounding the forwardly projecting member, each of said passages being acoustically separate from a point adjacent said transducers to a point where said passages reach said annular region said inlet having a cross-sectional area, said cross-sectional area of said acoustically common annular region of space including a region of substantially reduced cross-sectional area relative to the sum of said cross-sectional areas of said inlets.

15. The apparatus recited in claim 14 wherein said transducers are mounted symmetrically about the longitudinal axis of the forwardly projecting member.

16. The apparatus recited in claim 14 wherein said forwardly projecting member is rounded at its mounting point at least in the region where said passages meet said annular region.

17. The apparatus recited in claim 14, wherein said forwardly projecting member tapers substantially to point towards the front of said channel.

18. The apparatus recited in claim 14 wherein said transducers comprise compression drivers.

19. An apparatus comprising an adaptor for coupling the acoustic output of a plurality of sound transducers to a common horn, each of said transducers comprising an electromagnetic motor driving a diaphragm, said diaphragm having a surface area and operating into an acoustically isolated chamber having an outlet, said outlet having a cross-sectional area, said cross-sectional area being less than the surface area of said diaphragm, said horn comprising a longitudinally extending channel having acoustically closed sides and an acoustically open outlet at the front, said adaptor including a central longitudinally extending member mounted within said channel in alignment with the central axis of said channel and tapering towards the outlet of said channel, the surfaces of said longitudinally extending central member and of said channel defining an annular region towards the rear of said channel acoustically common to said output of each of said plurality of transducers, said adaptor including an acoustically isolated passage for each of said transducers, each of said passages coupling said outlet of a respective one of said transducers with said annular region, said apparatus including a region wherein the cross-sectional area of said annular region is substantially reduced relative to the sum of said cross-sectional areas of said transducer outlets, said passages each having a longitudinal axis substantially intersecting with the central axis of said longitudinally extending central member at an angle of greater than 90 degrees.

20. Apparatus according to any one of claims 1, 6, or 19, wherein said horn is suitable for use with a single transducer having an outlet diameter of substantially two inches.

21. Apparatus according to any one of claims 1, 6, 14, or 19, wherein the diameter of said outlets of said plurality of transducers is substantially one inch.

22. Apparatus according to any one of claims 1, 6, 14, or 19, wherein a surface of said adaptor body and said central member define the rearward portion of said annular region.

* * * * *